US006698866B2

(12) United States Patent
Ward et al.

(10) Patent No.: US 6,698,866 B2
(45) **Date of Patent: *Mar. 2, 2004**

(54) FLUID EJECTION DEVICE USING MULTIPLE GRIP PATTERN DATA

(75) Inventors: Jefferson P. Ward, Brush Prairie, WA (US); John M. da Cunha, Corvallis, OR (US); William J. Allen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/134,955

(22) Filed: Apr. 29, 2002

(65) Prior Publication Data

US 2003/0202044 A1 Oct. 30, 2003

(51) Int. Cl.[7] ..... B41J 2/21

(52) U.S. Cl. ..... 347/43

(58) Field of Search ..... 347/40, 43, 41, 347/12

(56) References Cited

U.S. PATENT DOCUMENTS 5,600,351 A * 2/1997 Holstun et al. ..... 347/40
6,547,354 B1 * 4/2003 Askeland et al. ..... 347/12

* cited by examiner

*Primary Examiner*—Thinh Nguyen

(57) ABSTRACT

The present invention includes as one embodiment a method for printing ink on a print media with a fluid ejection device of an inkjet printing mechanism, comprising generating first grid pattern data and second grid pattern data different from the first grid pattern data, sending the first grid pattern data to a first printing mechanism of the fluid ejection device and sending the second grid pattern data to a second printing mechanism of the fluid ejection device.

31 Claims, 6 Drawing Sheets

FLUID EJECTION DEVICE USING MULTIPLE GRIP PATTERN DATA

BACKGROUND OF THE INVENTION

Digital printing systems typically employ a dot placement pattern where circular dots are placed on a rectangular coordinated (Cartesian) grid. This pattern is convenient for the calculation of the placement of data and allows good generation of vertical and horizontal lines. However, the circular dots have to be relatively large to completely cover corresponding rectangular areas of the print media. A relatively large amount of overlapping of deposited ink occurs in areas directly between two adjacent dots, and a small amount of overlapping of deposited ink occurs at points on the grid that fall between diagonal dots. As such, rectangular systems using larger drops require more ink or toner to completely cover the print media and are not efficient for some printing applications.

One way to reduce the amount of ink overlap is to print on a hexagonal grid pattern. Hexagonal grid patterns inherently have an efficient geometry to allow circles to be closely packed when filling in an area on the print media, thus requiring less ink.

A system using a hexagonal grid will cover a higher percentage of the paper with a single drop, reducing the amount of ink required to cover a page. However, while hexagonal grid patterns produce high quality images, they are not optimal for other printing applications such as text and line graphics.

SUMMARY OF THE INVENTION

The present invention includes as one embodiment a method for printing ink on a print media with a fluid ejection device of an inkjet printing mechanism, comprising generating first grid pattern data and second grid pattern data different from the first grid pattern data, sending the first grid pattern data to a first printing mechanism of the fluid ejection device and sending the second grid pattern data to a second printing mechanism of the fluid ejection device.

BRIEF DESCRIPTION OF THE DRAWINGS

The present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention as defined by the claims appended below.

Figure 1:
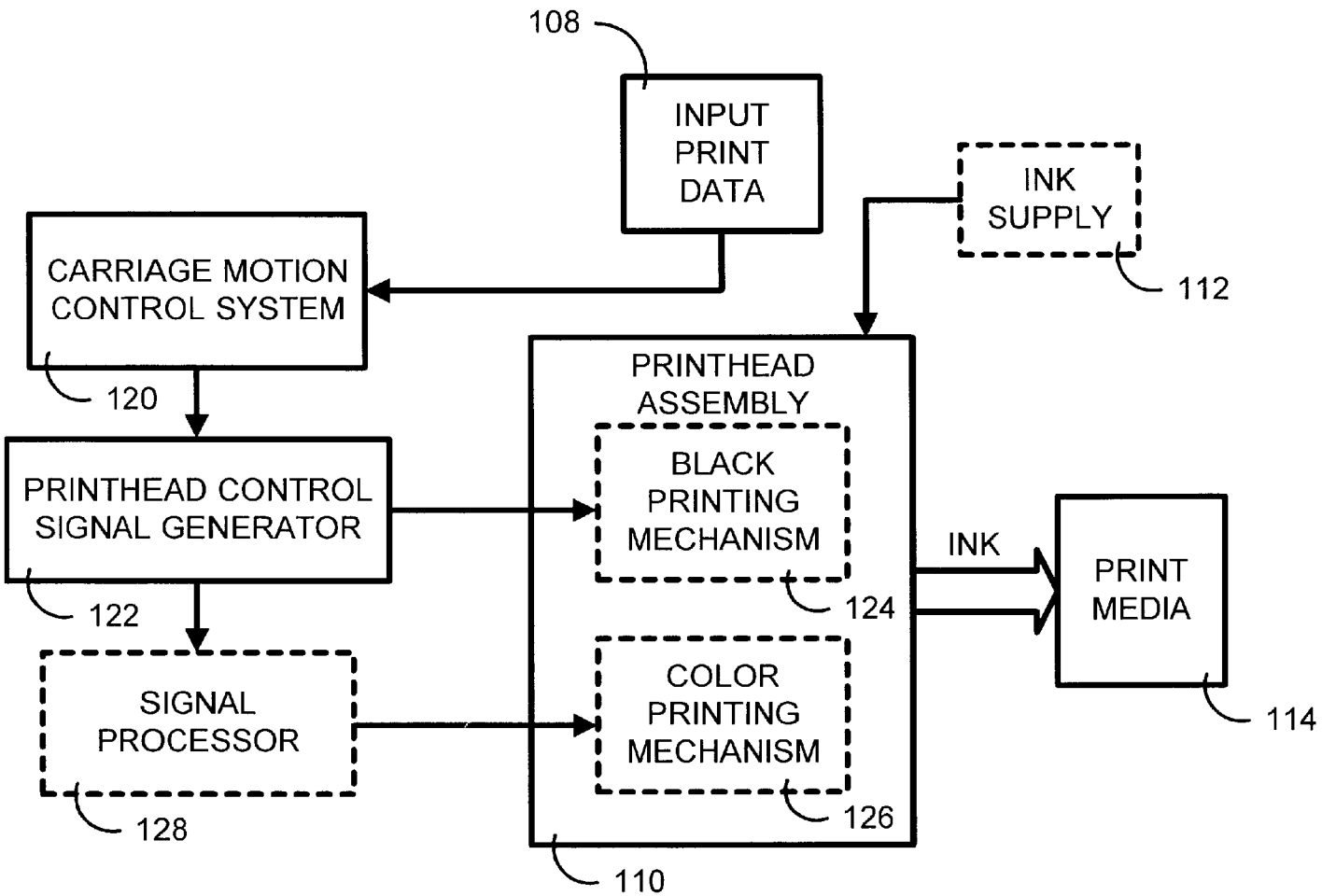
FIG. 1 is one embodiment showing an overall printing system incorporating the present invention.

I. General Overview of Components and Operation:

FIG. 1 is one embodiment showing an overall printing system incorporating the present invention. The printing system includes input print data 108 (contains information about the text and/or images to be printed), a printhead assembly 110, an ink supply 112 (shown in dotted lines because it can be located either remotely from or integrated with the printhead assembly 110) and print media 114. The printhead assembly 110, may have a number of printing mechanisms, each of which would include a printhead body and a nozzle system.

In addition, the printing system of FIG. 1 includes a carriage motion control system 120, a printhead control signal generator 122 and a signal processor 126, which can be a digital signal processor. The printhead control signal generator 122 and signal processor 128 may be incorporated in a custom application specific integrated circuit (ASIC). During a printing operation, ink is provided from the ink supply 112 to an interior portion (such as an ink reservoir) of the printhead assembly 110. The printhead assembly 110 receives commands derived from the input print data 108 to fire ink ejection elements of the printhead assembly 110 in order to release ink droplets for printing black and color ink as text, images, etc. on the print media 114. Print quality of the desired placement scheme is dependent on, among other things, accurate placement of the ink droplets on the print media 114.

In one embodiment of the invention, during operation, the carriage motion control system 120 electronically receives the input print data 108 and sends carriage location and position timing signals to the printhead control signal generator 122. The printhead control signal generator 122 processes these signals to control the correct placement of the ink to be printed. If the input print data 108 contains information for printing text, images, single bit black and white line art, etc. with black ink only (black ink data), the printhead control signal generator 122 generates first grid pattern data of a first placement scheme and sends it to at least one black printing mechanism 124 (multiple black printing mechanisms can be used), such as a black ink printhead or cartridge, of the printhead assembly 110. This allows black ink representing the black ink data to be printed on the print media 114 based on the first grid pattern data.

Alternatively or additionally, if the input print data 108 contains information for printing color text, color photographs, etc. with predominantly color ink and possibly some black ink (color ink data), the signal processor 128 of the printhead control signal generator 122 interpolates the color ink data and extracts position information for generating second grid pattern data of a second placement scheme, different from the first placement scheme. The second grid pattern data is then sent to at least one color printing mechanism 126 (multiple color printing mechanisms can be used), such as a color ink printhead or cartridge. This allows color text, color photographs, etc., representing the color ink data to be printed on the print media 114.

The grid placement schemes use dot matrix manipulation to form both images and alphanumeric characters to be printed. These schemes are created by predefined algorithms that may be implemented with the printer driver. Colors and tone of a printed image are modulated by the presence or absence of drops of ink deposited on the print medium at each target picture element or dot (referred to as a "pixel") of a superimposed grid overlay of the image to be printed of a particular grid placement scheme.

Also, it should be noted that both the first and second grid pattern data are typically sent simultaneously to the printhead assembly 110. Also, additional black and color printing mechanisms can be used with corresponding grid pattern data different than the first and second grid patterns. As such, the printhead assembly 110 uses multiple grid pattern data during a single printing operation.

In one embodiment, a rectangular grid placement scheme is used for firing black ink on the print media 114 and a hexagonal grid placement scheme is used for firing color ink on the print media 114. Color ink data includes color ink and also may contain black ink on the printed output. For example, print data of a color photographic image would likely contain both color ink and black ink, but would be categorized as color ink data. In contrast, print data for black text would contain black ink without color ink and be categorized as black ink data. As such, black ink could exist in color ink data (images and color text for color graphic presentations, color newsletters, color business charts, color photographs, etc.), but color ink typically would not exist in black ink data (black text for monochrome documents and single bit black and white line art printouts).

In another embodiment, a signal processor 128, such as a digital signal processor, is optionally used to receive the color ink data from the printhead control signal generator 122 for analyzing and interpolating the color ink data to extract the position information for generating the second grid pattern. The signal processor 128 is used to digitally interpolate and subdivide or time slice the position and timing signals of the color ink data for generating a hexagonal grid pattern as the second grid pattern. This could also be performed by custom logic included in a main control application specific integrated circuit. It should be noted that the black and color printing mechanisms are shown with dotted lines because they can be separate print cartridges.

Each black and color printing mechanism 124, 128 receives data formatted according to a different preprogrammed grid placement scheme as part of the firing signals for producing systematic ink drop placement on the print media 114. A general grid placement scheme can be developed for a type of inkjet printhead assembly during design of the assembly. The grid placement schemes used in the embodiments of the inkjet printhead assemblies of the present invention may include a rectangular grid and a hexagonal grid. Other geometrical grids can be used, such as circular grids, triangular grids, octagonal grids, etc.

The grid placement scheme can be implemented by a printer driver implemented as software operating on a computer system that is connected to the inkjet printer or as firmware incorporated into the printer in a controller device. Also, the grid placement scheme can be encoded on a memory device incorporated into the inkjet printhead assembly itself. Information can be written and stored at the time the printhead assembly is manufactured or during printer operation. The grid placement scheme can typically be accessed and applied by the printer driver.

Since the embodiments of the present invention supports both rectangular and hexagonal grid printing, text and line art can be rendered with a rectangular grid pattern, while images can be rendered with a hexagonal grid pattern. Text and line art, which typically have significant areas of vertical and horizontal lines but low ink density (i.e. lots of unprinted white space) are efficiently printed with a rectangular grid pattern. Images, such as photographic images, however, which have high ink density are printed with a hex grid pattern so as to conserve consumables, such as ink/toner. In addition, the multiple grid pattern system decreases the adverse visual effects of defective nozzles so as to maintain a higher quality throughout the print swath.

Figure 2:
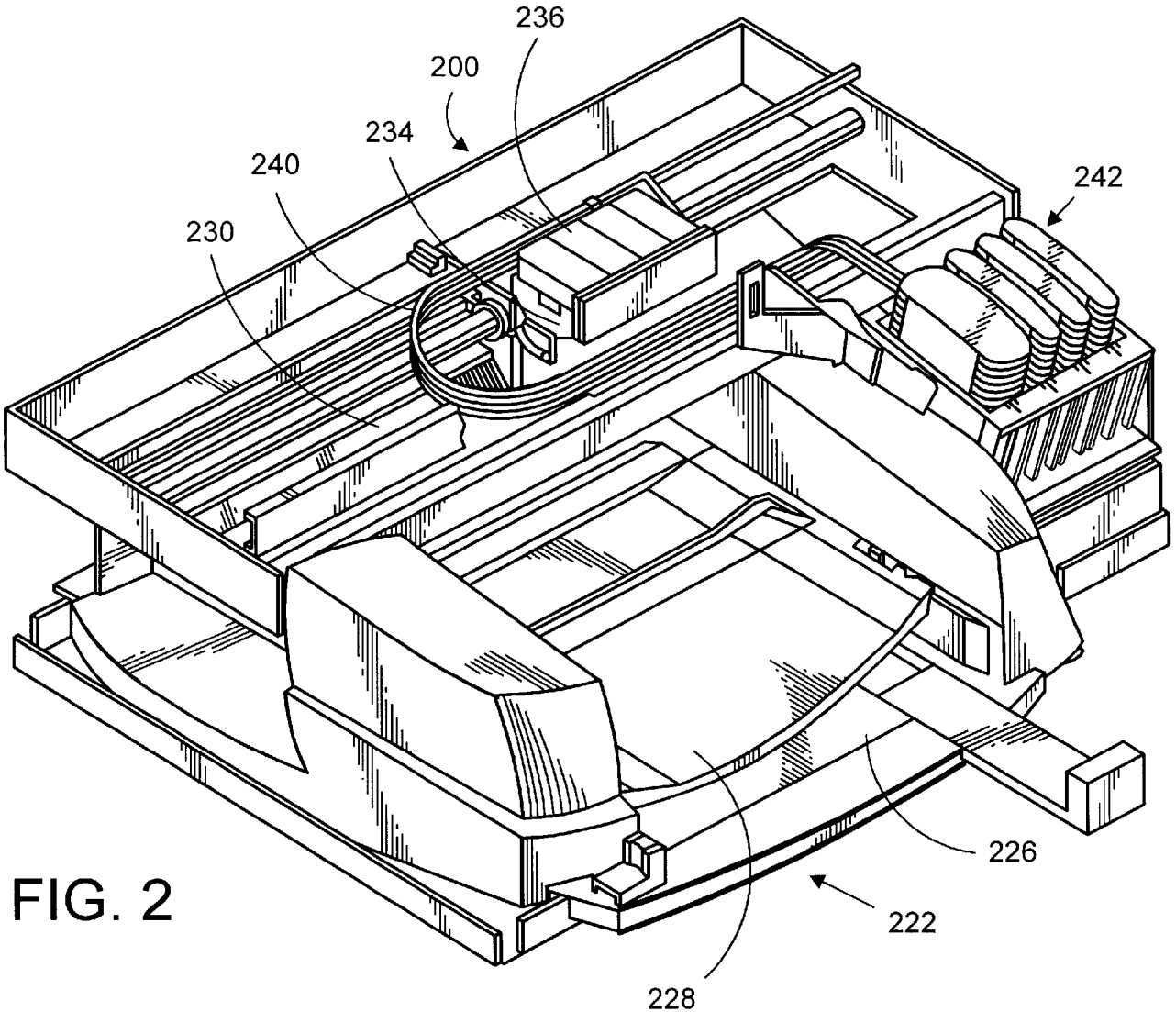
FIG. 2 is one embodiment showing an exemplary printer that incorporates the present invention and is shown for purposes of illustration.

II. Exemplary Printing System:

FIG. 2 is one embodiment of an exemplary inkjet printing mechanism or arrangement, an "off-axis" high-speed printer, that incorporates an embodiment of the invention, which is shown for illustrative purposes only. The inkjet printing arrangement or printer 200 of FIG. 2 may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, point of sale (POS) horizontal printers and facsimile machines, to name a few, as well as various combination devices, such as a combination facsimile/printer and a combination scanner/copier/printer or "All in One" device. For convenience the concepts of the present invention are illustrated in the environment of an inkjet printer 200.

While it is apparent that the printer components may vary from model to model, the typical inkjet printer 200 includes the printhead assembly 110 of FIG. 1 and further includes a tray 222 for holding print media. When printing operation is initiated, print media, such as paper, is fed into printer 200 from tray 222 using sheet feeder 226. The sheet is then brought around in a U turn and then travels in an opposite direction toward output tray 228. Other paper paths, such as a straight through paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire image sheet has been printed, at which point the sheet is ejected into the output tray 228.

The print assemblies 236 can be removeably mounted or permanently mounted to the scanning carriage 234. Also, the printhead assemblies 236 can have self-contained ink reservoirs. Alternatively, each print cartridge 236 can be fluidically coupled, via flexible conduits 240, to one of a plurality of fixed or removable ink containers 242 acting as the ink supply. Further, the printer 200 can include a carriage position locator (not shown), such as an encoder. The encoder is typically a single electrical-optical component consisting of an electrical emitter (LED), a photo detector (photodiode) with some form of a mask which sets an encoder pitch or resolution that resides on the carriage. The encoder is mechanically positioned relative to a fixed encoder strip (linear in nature) such that as the carriage traverses reversibly along a carriage rod, it can detect position data printed on the encoder strip.

There are other types of encoders, such as an electromagnetic encoders. With these encoders, the carriage is an electro-mechanical assembly consisting in part of the carriage, carriage electronics, timing belt attachment, print head latching mechanism, electrical print head interconnection and electrical interconnect to the main controller. The printheads are electro-mechanically attached to the carriage. Signals detected by the encoder are sent to the main controller where they are utilized to determine and control the location of the carriage.

Signal output is also routed to a printhead firing control component which may be a separate component located on either the carriage or the main logic controller or may be integrated into the print head assembly. Print data is generated on a host and transmitted to the printer in any of a number of data formats. Data received at the main controller is decoded and turned into printhead assembly firing commands. Firing commands are synchronized to encoder pulses by a firing control component of the printhead. This data is used to initiate the flow of power to individual firing resistors within a printhead.

Figure 3:
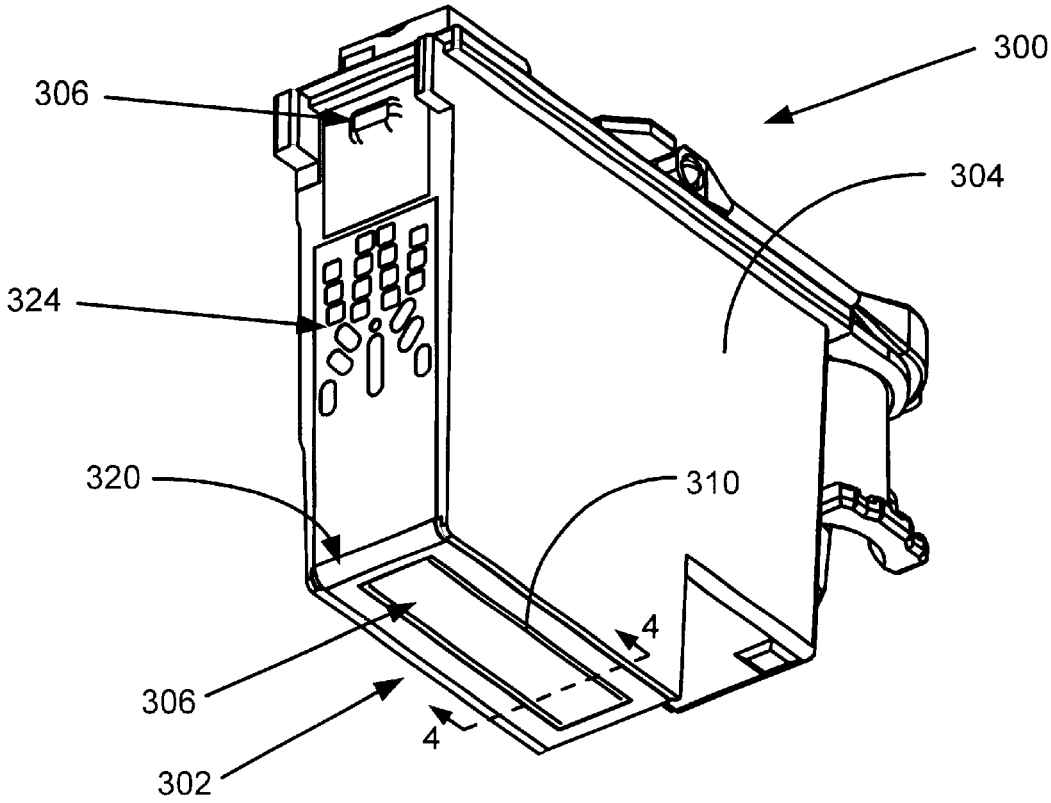
FIG. 3 is one embodiment showing for illustrative purposes only a perspective view of an exemplary print cartridge incorporating the present invention and usable with the printer of FIG. 2.

FIG. 3 shows one embodiment for illustrative purposes only, of a perspective view of an exemplary printhead assembly 300 (an example of the printhead assembly 110 of FIG. 1). A detailed description of an embodiment of the present invention follows with reference to a typical printhead assembly used with a typical printer, such as printer 200 of FIG. 2. However, other printhead and printer configurations may be employed depending upon the particular implementation.

Referring to FIGS. 1 and 2 along with FIG. 3, the printhead assembly 300 is comprised of a nozzle member 302 through which drops of at least one ink are ejected onto the print media, a printhead body 304 and a printhead memory device 306. The printhead assembly 110 includes a flexible circuit 320, which can be a flexible material commonly referred to as a Tape Automated Bonding (TAB) circuit bonded to the printhead assembly 110. The flexible circuit 320 also includes an interconnect area 324 with interconnect contact pads that align with and electrically contact electrodes (not shown) on carriage 234 of FIG. 2.

In one embodiment, the nozzle member 302 contains printhead drive circuitry (not shown). The printhead drive circuitry comprises a distributive processor (not shown) coupled to the nozzle member 302. The distributive processor may include digital and/or analog circuitry and communicates via electrical signals with a controller (not shown), nozzle member 302 and various analog devices, such as temperature sensors, which can be located on the nozzle member 302. The distributive processor processes the signals for precisely controlling firing, timing, thermal and energy aspects of the printhead assembly 110 and nozzle member 302. The nozzle member 302 typically contains plural orifices or nozzles 310, which can be created by, for example, laser ablation, for creating ink drop generation on a print media.

Figure 4A:
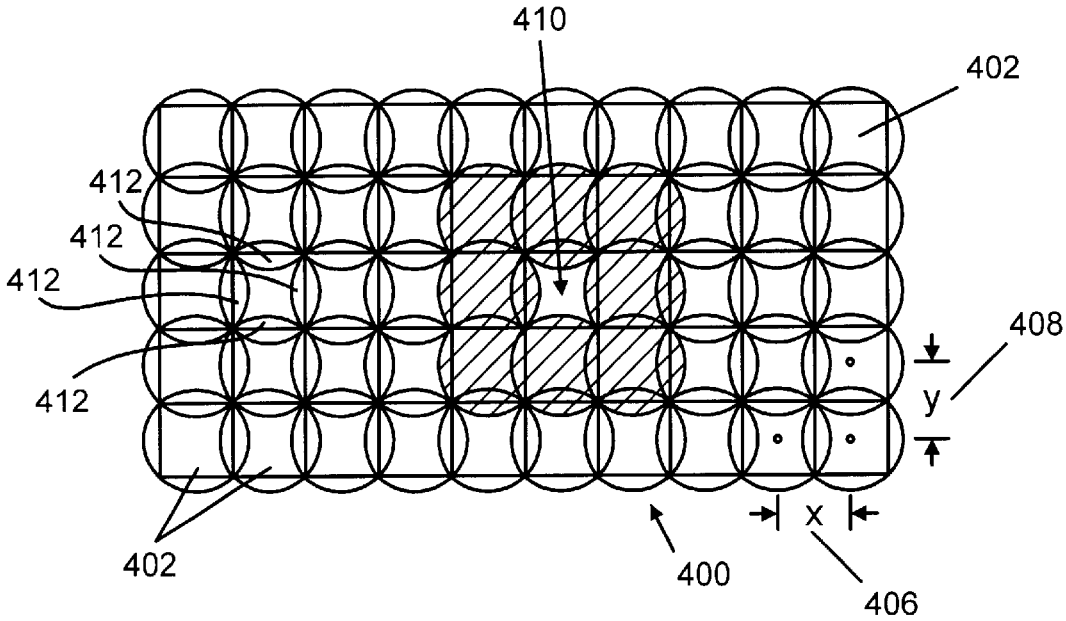
FIG. 4A is a diagram illustrating one embodiment with a pattern of ink droplets printed using a rectangular grid pattern.

III. Details of the Operation:

FIG. 4A is a diagram illustrating one embodiment with a pattern of ink droplets using a rectangular grid pattern. The input data is formatted by predefined algorithms to conform to predetermined dot grid patterns. These grid patterns may be understood as invisible overlays (created by predefined algorithms) that define the positions on the print medium onto which ink droplets may be deposited. The formatting of the input data according to these grid patterns may be implemented with the printer driver. The input data, when printed according to these dot grid patterns, form both the images and alphanumeric characters to be printed.

The rectangular grid pattern 400 is typically used for generating text and line art typically printed with black ink. The rectangles typically are squares 402. This rectangular grid 400 could model a six hundred by six hundred (600×600) dot per inch (dpi) printing mode where a carriage scan pitch 406 or center-to-center spacing of printed ink drops 402 along an x axis equals paper motion pitch 408 or center-to-center spacing of ink drops 402 along a y axis. In order for a substantially circular ink drop to fully cover a square 402, the ink drop will also cover overlapping portions of adjacent squares. In the case of a printing mode with equal print density (i.e. dots per inch) in both the x and y directions (such as 600×600 dpi), the portion of a square 410 covered by neighboring ink drops 402 is about 57% of the area of the square 410, as illustrated by overlapped regions 412.

Figure 4B:
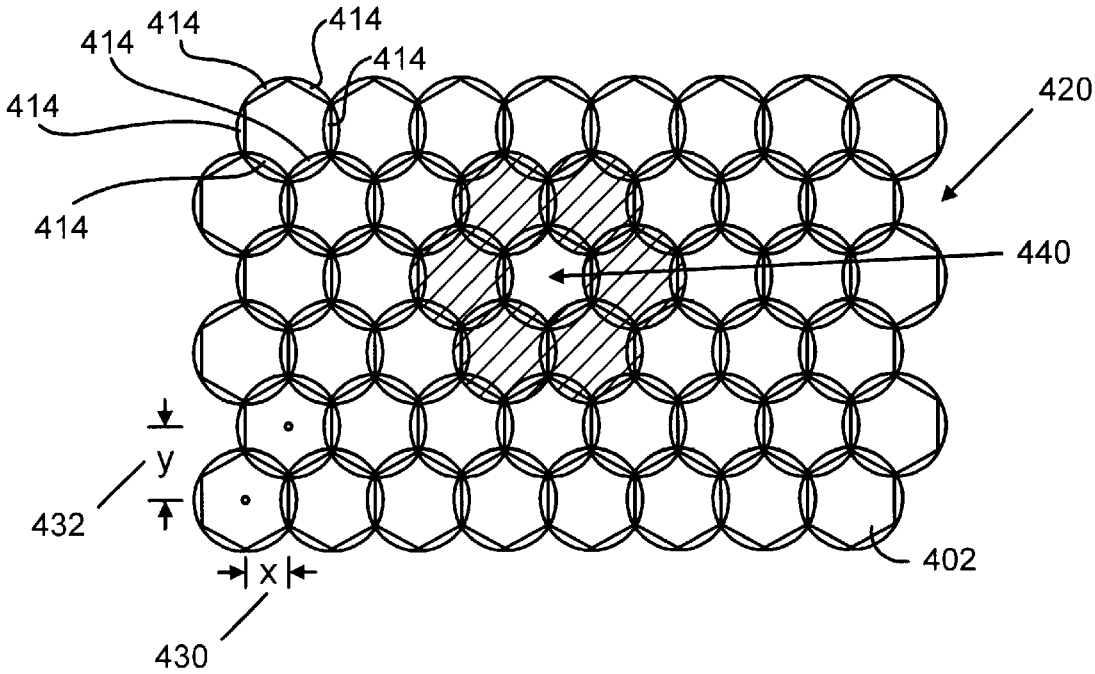
FIG. 4B is a diagram illustrating one embodiment with a pattern of ink droplets printed using a hexagonal grid pattern.

FIG. 4B is a diagram illustrating one embodiment with a pattern of ink droplets using a hexagonal grid pattern. FIG. 4B shows a hexagonal grid pattern 420 of ink droplets 402 that may be used for generating images and graphics typically printed with but not limited to color ink, wherein the ink drops 402 are placed on hexagonal grid pattern 420 to increase coverage efficiency. A carriage scan pitch 430 of the ink drops 402 along an x axis is related to paper motion pitch 432 of the ink drop 402 along a y axis. In one hexagonal grid pattern embodiment, x=cube root of y. With the hexagonal grid 420, the portion in a given hexagon 640 covered by neighboring ink drops 402 is only about a 21% are 414, which is less than that for the square grid case discussed above with reference to FIG. 4A. In other words, in the y axis, the dot pitch is unchanged.

However, in the x axis, the dot pitch is adjusted to match a suitable ratio for a rectangular-hex grid. Ink deposited on top of ink has much less visual effect than ink deposited on an unprinted portion of the print media 114. As such, the larger the percentage of the paper covered by only one drop in the pattern, namely drop 440, the higher the coverage efficiency of the system. In this embodiment, the area with the least amount of drop-to-drop overlap is covered. Consequently, the hexagonal grid pattern 620 reduces the volume of ink required to entirely cover the print media 114, and therefore the amount of ink per unit area of print medium requires for coverage.

In one embodiment, both the rectangular and hexagonal grid patterns are used at the same time when printing an image (rectangular grid is used for black ink data and hexagonal grid for color ink data). Specifically, since text and single bit line art are predominantly printed with black ink, a rectangular grid pattern is used for black ink data to minimize manufacturing and design changes. However, for color ink data, which can include color photographs, color presentations, etc., the hexagonal grid is typically used to produce more efficient and continuous print coverage.

Figure 5:
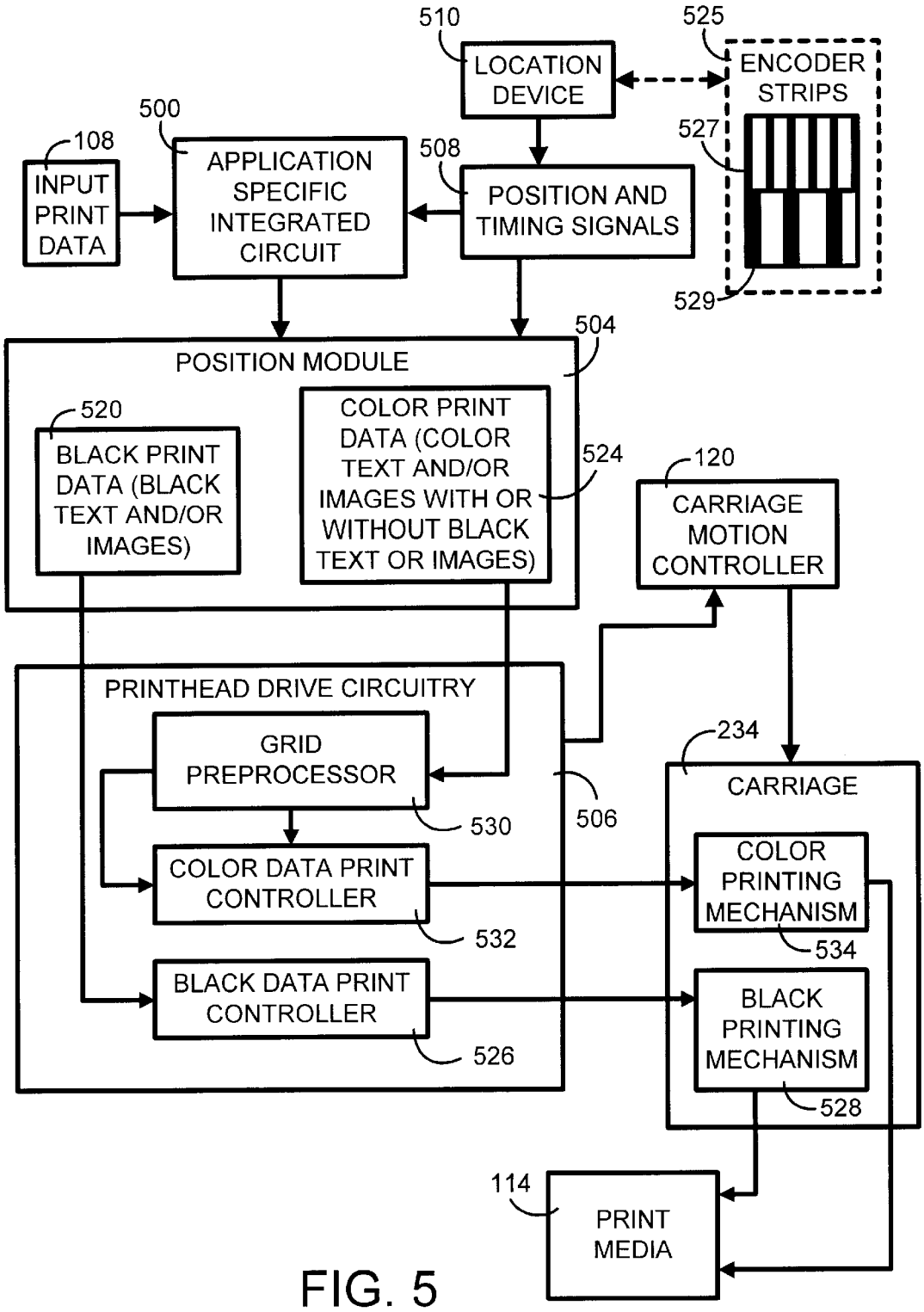
FIG. 5 is a high level block diagram illustrating another embodiment of the present invention.

IV. Working Example:

FIG. 5 is a high level block diagram illustrating one embodiment that includes a working example of the present invention. In this working example, the printer 200 of FIG. 2 includes an application specific integrated circuit (ASIC) 500, which can be a digital or analog device, a position module 504 and printhead drive circuitry 506 for controlling operations of the printhead 110 of FIG. 1 and producing printed output with multiple grid patterns in a single printing system. It should be noted that the ASIC 500, position module 504 and printhead drive circuitry 506 can be incorporated as a single unit or each may reside in any suitable location within the printing system. For example, in one embodiment, the ASIC 500 and position module 504 reside on an inside location of the printer 200, remote from the printhead 110, while the printhead drive circuitry 506 is located directly on the printhead 110.

Input print data 108 is generated for each print job and received by the ASIC 500. Position and timing signals 508 of the carriage 234 are generated based on a location device 510 and sent to the ASIC 500 for processing. The ASIC 500 decodes the print data 108 and synchronizes the decoded information with the position and timing signals 508. This information is forwarded, via the position module 504, to the printhead drive circuitry 506. The position module 504 may be a closed loop encoder system that uses an optical encoder module coordinated with positioning strips that are read by optional encoders to precisely locate the carriage and accurately print the input data 108. Alternatively, the position module 504 can be an open loop servo system that uses a crystal oscillator and a stepper motor to precisely locate the carriage and accurately print the input data 108.

The position module 504 generates black print data 520 (black text, black images, etc.) and color print data 524 (color text, color images, etc., with or without black print data). In the case where the position module 504 is an optical encoder module, encoders are used to gather position data of the carriage 234 in any suitable manner, but typically from either a single optical encoder strip or a multiple optical encoder strip that is located on a scan axis of the carriage 234. A single optical encoder strip 525 (shown in dotted lines as an optional element that is used with a system with optical encoders) would contain encoder markings for both black and color ink data 527, 529 and optically detected by an encoder calibrated with the carriage 234. Multiple optical encoder strips that can be used include a dual strip (one black strip for black text and one color strip for color text and images) or a triple optical encoder strip (one strip for black text, one strip for black images, and one strip for color text and images) can be used.

In the embodiment that uses a single optical encoder strip, black ink data is generated from black linear encoder markings 527 of the strip 525. For color ink data, the encoder strip 525 comprises color linear encoder markings 529, which is one a different pitch than the black linear markings 527 for producing different grid pattern data. For example, for a system that uses a rectangular grid for black ink data and a hexagonal grid for color ink data, the color markings have a carriage scan pitch equal to the cube root of the paper motion pitch, and the black markings have a carriage scan pitch equal to the paper motion pitch. This is because every other row of dots in the hexagonal grid is offset by one-half the dots in the x-axis in comparison to the rectangular grid and as discussed above with reference to FIG. 4, in the hexagonal grid pattern, x=cube root of y.

The markings 527, 529 are read by at least one encoder, but typically dual encoders, one for each marking, which produces position and timing pulses that are used by the printhead assembly firing process. When a single encoder strip with dual markings is used, the printhead assembly or assemblies in the printer are synchronized to the single encoder for the single strip. Fire pulses are generated by the printhead drive circuitry 506 based on position and timing signals received by the position module 504 and the strip markings. As discussed above, these position and timing signals can be subdivided by any suitable device to produce multiple grid patterns.

During a printing operation, for black text and black images, the black print data 520 is sent to a black data print controller 526 and includes position and timing signals for the black ink to be printed. The black data print controller 526 interprets these signals and translates them into firing signals for the black printing mechanism 528. In one embodiment, the firing signals contain Cartesian coordinate grid information, such as rectangular grid pattern data for firing specific black ink on the print media 114.

In a system that does not use the encoder strip 525 with dual markings 527, 529, for color ink, the color print data 524 is sent to a grid preprocessor 530 that analyzes and processes the position and timing signals from the location device 510 for generating grid pattern data different from the black print data 520. The preprocessor 530 subdivides or time slices the position and timing signals as interpolated signals. The interpolation can be formulated for any predefined time division associated with a particular grid pattern. For example, a hexagonal grid pattern can be created by subdividing the position and timing signals of the Cartesian based rectangular grid pattern with a one-half time division. A one-half time division interpolation is used because every other row of dots in the hexagonal grid is offset by one-half the dots in the x-axis in comparison to a Cartesian rectangular grid. The hexagonal grid pattern data is used for firing color ink on the print media 114 and sends this to a color print controller 532. The color print controller 532 interprets these signals and translates them into firing signals for the color printing mechanism 534.

In this embodiment, the encoder strip is used as the location device 510 to generate the position and timing signals 508. The ASIC 500 can be used to subdivide the position and timing signals 508 into multiple time divisions with time slicing techniques, for example with a digital signal processor (DSP) or custom hardware logic programmed for this task, for creating different grid patterns, other than the black print data.

In particular, referring to FIGS. 1–2 along with FIG. 5, the printhead drive circuitry 506 sends the position and timing signals 508 to the scanning carriage 234 via the carriage motion controller 120. The scanning carriage 234 analyzes the data so that it can be positioned for black print data or color print data. The printhead drive circuitry 506 also calculates the position of each ink droplet through a drop position controller for black and for color.

Figure 6:
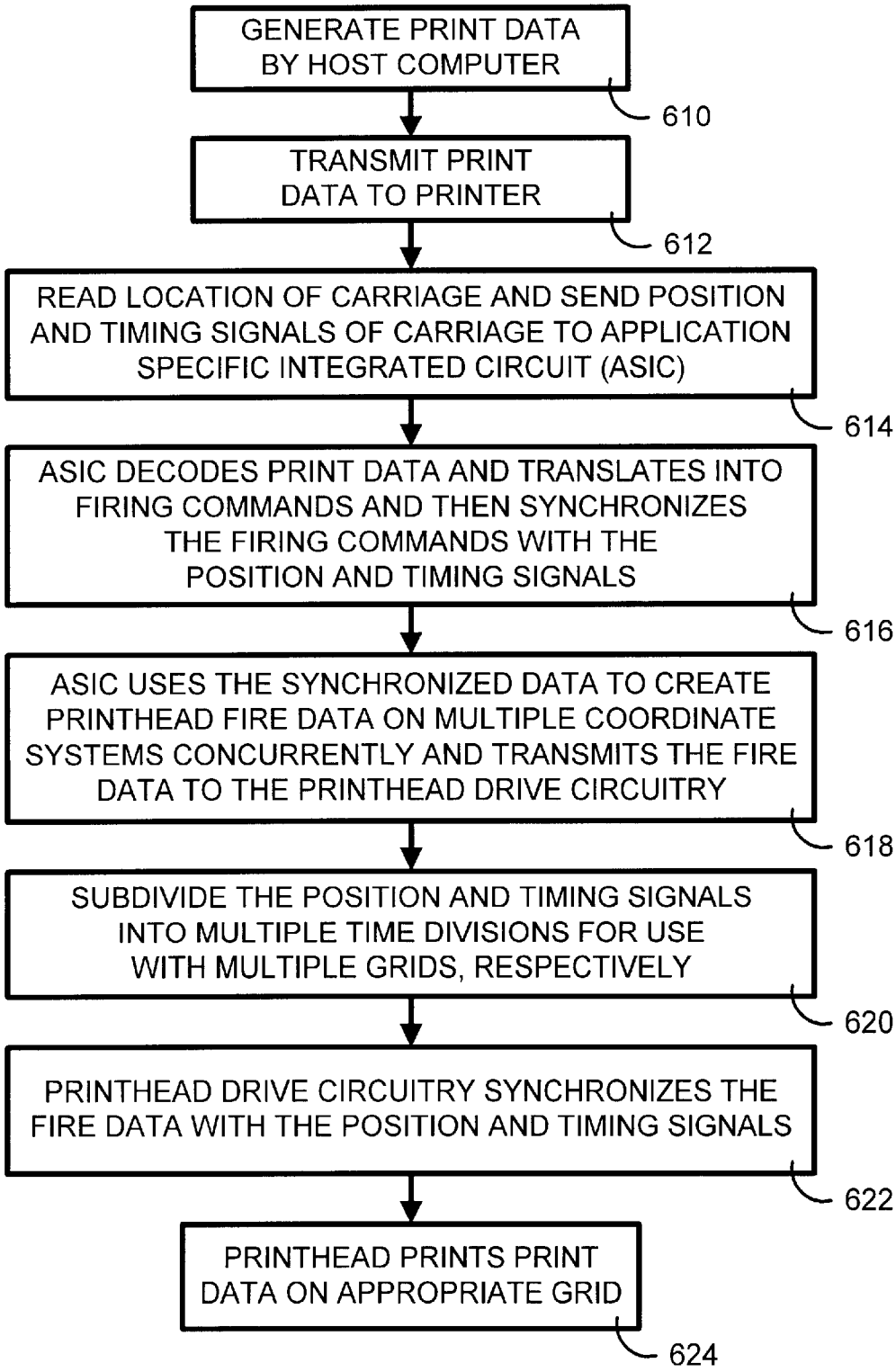
FIG. 6 is a high level flow diagram illustrating a further embodiment of the present invention represented by FIG. 5.

FIG. 6 is a high level flow diagram illustrating one embodiment of the present invention that is represented by of FIG. 5. Referring to FIGS. 1–5 along with FIG. 6, in operation, first, print data 108 is generated by a host computer (step 610). Second, the print data 108 is transmitted to the printer 200 (step 612). Third, the location of the carriage is read to generate position and timing signals 508 of carriage 234. The position and timing signals 508 are sent to the ASIC 500 (step 614). Fourth, the ASIC 500 decodes the print data 108 and translates it into firing commands. The firing commands and the position and timing signals 508 are then synchronized (step 616). Fifth, the ASIC 500 uses the synchronized data to concurrently create printhead fire data on multiple coordinate systems. This fire data is transmitted to the printhead drive circuitry (step 618).

Sixth, the position and timing signals 508 are subdivided into multiple time divisions for use with multiple grids, respectively (step 620). Namely, for the multiple grid pattern system that includes rectangular grid data for black print data 520 and hexagonal grid data for color print data 524, the position and timing signals 508 are subdivided, for black print data 520, into first time divisions for rectangular grid pattern data. For the color print data 524, the position and timing signals 508 are subdivided into second time divisions that are smaller that the first time divisions for hexagonal grid pattern data. Next, the printhead drive circuitry 506 synchronizes the fire data with the position and timing signals 508 (step 622). Last, the printhead 110 prints the print data 108 using an appropriate grid on the print media 114 (step 624).

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A method for printing with an inkjet printer, comprising:

generating first grid pattern data according to a first grid pattern and second grid pattern data according to a second grid pattern different from the first grid pattern;

sending the first grid pattern data to a first printing mechanism of the inkjet printer; and sending the second grid pattern data to a second printing mechanism of the inkjet printer.

2. The method of claim 1, wherein the first grid pattern is a rectangular grid pattern and the second grid pattern is a hexagonal grid pattern.

3. The method of claim 2, wherein the first printing mechanism is a black ink printhead and the second printing mechanism is a color ink printhead.

4. The method of claim 3, wherein the hexagonal grid pattern has a carriage scan pitch equal to the cube root of the paper motion pitch, and the rectangular grid pattern has a carriage scan pitch equal to the paper motion pitch.

5. The method of claim 1, further comprising producing position and timing signals and interpolating the position and timing signals before the second grid pattern data is sent to the second printing mechanism to produce hexagonal grid pattern data.

6. The method of claim 5, wherein interpolating the control signal includes time slicing the control signal for generating the hexagonal grid pattern data.

7. An inkjet printing mechanism, comprising:

a fluid ejection device for printing ink with at least a first printing mechanism and a second printing mechanism;

a fluid ejection control signal generator that generates first grid pattern data and second grid pattern data, wherein the second grid pattern is different from the first grid pattern, and wherein the first grid pattern data is sent to the first printing mechanism and the second gild pattern data is sent to the second printing mechanism.

8. The inkjet printing mechanism of claim 7, wherein the first printing mechanism is a black ink printing device and the second printing mechanism is a color ink printing device.

9. The inkjet printing mechanism of claim 8, wherein the carriage motion control system includes an optical encoder strip and optoelectronics that encodes the optical encoder strip for accurately locating and controlling the motion of the carriage.

10. The inkjet printing mechanism of claim 7, wherein the first grid pattern is a rectangular grid pattern for a black ink printing device and the second grid pattern is a hexagonal grid pattern for a color printing mechanism.

11. The inkjet printing mechanism of claim 7, further comprising a carriage motion control system for controlling the motion of a carriage holding the fluid ejection device.

12. The inkjet printing mechanism of claim 7, further comprising a signal processor that receives the second grid pattern before it is sent to the second printing mechanism for interpolating position and timing signals relating to the second grid pattern to produce hexagonal grid pattern data.

13. The inkjet printing mechanism of claim 12, wherein interpolating the control signal includes time slicing the control signal for generating the hexagonal grid pattern data.

14. The inkjet printing mechanism of claim 7, further comprising an encoder strip with black markings for producing the first grid pattern data and color markings for producing the second grid pattern data.

15. The inkjet printing mechanism of claim 14, wherein the color markings have a carriage scan pitch equal to the cube root of a paper motion pitch and the black markings have a carriage scan pitch equal to the paper motion pitch.

16. The inkjet printing mechanism of claim 7, further comprising an open loop servo system that uses a crystal oscillator and a stepper motor to produce the first and second grid pattern data and precisely locate the printing mechanisms.

17. An inkjet printing mechanism for printing ink on a print media with a fluid ejection device, comprising:

means for sending rectangular grid pattern data to a black printing mechanism of the fluid ejection device; and means for sending hexagonal grid pattern data to a color printing mechanism of the fluid ejection device.

18. The inkjet printing mechanism of claim 17, wherein the means for sending hexagonal grid pattern data to the color printing mechanism includes sending both hexagonal and rectangular grid pattern data to the color printing mechanism.

19. An inkjet printing apparatus for printing ink on a print media, comprising:

a fluid ejection control signal generator that generates a control signal including rectangular and hexagonal grid pattern data and sends the rectangular grid pattern data to a black printing mechanisms, one for black text and one for black images;

a signal processor that preprocesses position and timing signals associated with the hexagonal grid pattern data and sends it to the color printing mechanism; and a carriage motion control system for controlling the motion of a carriage holding the printhead.

20. The inkjet printing apparatus of claim 19, wherein sending hexagonal grid pattern data to the color printing mechanism includes sending both hexagonal and rectangular grid pattern data to the color printing mechanism simultaneously.

21. The inkjet printing apparatus of claim 19, further comprising a digital signal processor for preprocessing the control signal and sending the preprocessed control as hexagonal grid pattern data to the color printing mechanism.

22. The inkjet printing apparatus of claim 19, wherein preprocessing the control signal includes interpolating the control signal to produce the hexagonal grid pattern data.

23. The inkjet printing apparatus of claim 22, wherein interpolating the control signal includes subdividing and time slicing the control signal for generating the hexagonal grid pattern data.

24. The inkjet printing apparatus of claim 19, wherein the carriage motion control system includes an optical encoder strip and optoelectronics for encoding the optical encoder strip for controlling the motion of the carriage.

25. The inkjet printing apparatus of claim 24, further comprising a black optical encoder strip, a separate color optical encoder strip, a black optoelectronic encoder and a color optoelectronic encoder for encoding the optical encoder strips separately.

26. The inkjet printing apparatus of claim 19, wherein the signal processor is a custom application specific integrated circuit.

27. A method using a computer-readable medium having computer-executable instructions for generating multiple grid pattern data for printing ink on a print media with an inkjet printhead of an inkjet printing arrangement, the method comprising:

receiving position and timing signals of the inkjet printhead;

subdividing the position and timing signals into multiple time divisions; and associating the subdivided time divisions with corresponding multiple grid patterns.

28. The method of claim 27, wherein a first grid pattern data is rectangular grid pattern data for a black ink printing device and a second grid pattern data is hexagonal grid pattern data for a color printing mechanism.

29. The method of claim 28, further comprising:

receiving position and timing signals of the black printing mechanism and the color printing mechanism;

subdividing the position and timing signals into multiple time divisions; and associating a predefined grid pattern with each subdivided time division.

30. A method for printing with an inkjet printer, comprising:

sending rectangular grid pattern data to a black printing mechanism of the inkjet printer; and sending hexagonal grid pattern data to a color printing mechanism of the inkjet printer.

31. The method of claim 30, wherein sending hexagonal grid pattern data to the color printing mechanism includes sending both hexagonal and rectangular grid pattern data to the color printing mechanism.

* * * * *

UNITED STATES PATENT AND TRADEMARK OFFICE

CERTIFICATE OF CORRECTION

PATENT NO. : 6,698,866 B2
DATED : March 2, 2004
INVENTOR(S) : Ward et al.

It is certified that error appears in the above-identified patent and that said Letters Patent is hereby corrected as shown below:

Column 9,
Line 54, delete “gild” and insert in lieu thereof -- grid --.

Signed and Sealed this

Tenth Day of August, 2004

JON W. DUDAS
*Acting Director of the United States Patent and Trademark Office*